US008251533B2

(12) United States Patent
Imperial

(10) Patent No.: US 8,251,533 B2
(45) Date of Patent: Aug. 28, 2012

(54) ILLUMINARY ASSEMBLY

(75) Inventor: Anthony Imperial, San Francisco, CA (US)

(73) Assignee: Nextarts, San Francisco, CA (US)

( * ) Notice: Subject to any disclaimer, the term of this patent is extended or adjusted under 35 U.S.C. 154(b) by 457 days.

(21) Appl. No.: 12/404,199

(22) Filed: Mar. 13, 2009

(65) Prior Publication Data

US 2010/0039800 A1 Feb. 18, 2010

Related U.S. Application Data

(60) Provisional application No. 61/196,696, filed on Aug. 15, 2008.

(51) Int. Cl.

| | |
|---|---|
| ***F21V 33/00*** | (2006.01) |
| ***F21V 35/00*** | (2006.01) |
| ***F21L 19/00*** | (2006.01) |
| ***F21V 3/00*** | (2006.01) |
| ***F21V 5/00*** | (2006.01) |

(52) U.S. Cl. ..... 362/101; 362/161; 362/311.13

(58) Field of Classification Search ..... 362/101, 362/154, 161, 162, 163, 180, 311.13, 312, 362/360, 806; 206/573

See application file for complete search history.

(56) References Cited

U.S. PATENT DOCUMENTS

| | | | | |
|---|---|---|---|---|
| 4,594,646 | A * | 6/1986 | Von Kohorn et al. | 362/101 |
| 4,937,701 | A * | 6/1990 | Schroder | 362/161 |
| 5,178,451 | A * | 1/1993 | Henry | 362/161 |
| 5,791,774 | A * | 8/1998 | Briles | 362/392 |
| 2008/0130266 | A1 * | 6/2008 | DeWitt et al. | 362/96 |

OTHER PUBLICATIONS

Simply Luminaries, "Candle Luminaries Kit", Dec. 2, 2003, available at http://replay.waybackmachine.org/20031202022553/http://simplyluminaries.com/candle_luminaries.html, last accessed Mar. 1, 2011*

* cited by examiner

*Primary Examiner* — David Crowe
(74) *Attorney, Agent, or Firm* — Perkins Coie LLP

(57) ABSTRACT

An improved luminaria assembly with controlled ballast mechanism is provided. In one embodiment, the improved luminaria assembly has an outer container and an inner reservoir. In some instances, the outer container and inner reservoir are assembled over a base. The inner reservoir is configured to hold a controlled volume of ballast for the improved luminaria assembly and also to hold an illuminating source. In one embodiment, spillover cavities are provided on the base region surrounding the inner reservoir to enable removal of excess ballast from the inner reservoir. In one embodiment, a decorative sleeve is inserted in the region between the outer container and the inner reservoir. The decorative sleeve contains decorative elements that are visible when the luminaria is illuminated using the illuminating source. In some instances, the improved luminaria assembly is treated with fire retardants to mitigate fire hazards.

18 Claims, 6 Drawing Sheets

ILLUMINARY ASSEMBLY

CROSS REFERENCE TO RELATED APPLICATIONS

This application claims priority to U.S. Provisional Application No. 61/196,696, filed Aug. 14, 2008, entitled ILLUMINARY ASSEMBLY, which is hereby incorporated by reference in its entirety.

FIELD OF THE INVENTION

At least one embodiment of the present invention pertains to an improved luminaria assembly, and more specifically pertains to a luminaria assembly with controlled ballast usage.

BACKGROUND

A luminaria, in general terms, refers to a light source or a small lantern. The luminaria is most commonly a candle in a paper lamp shade, used as a holiday lantern. In some countries, including the United States, the luminaria is made from brown paper bags, weighted down with some form of ballast (e.g., sand, gravel, water, etc.) and illuminated from within by a light source (e.g., a candle). Luminarias have been used traditionally since the 16th century as a holiday lantern, as a means to denote trails for people traveling to a church or other gatherings during the holiday season. Luminarias are typically arranged in rows to create elaborate displays.

The earliest luminarias were made by using small bonfires along, for example, a trail to a church. During the 1700s, traditional Christmas luminarias were made using a candle set in sand within a paper bag. In some places, luminarias are made using votive candles placed within paper bags, weighted down using sand in the paper bags. Modern luminarias use LED lights or electric bulbs to provide the light source. Although luminarias started out as a holiday tradition, it is currently used in a plethora or festive occasions and is not restricted to specific religious events.

Luminarias are most frequently used in a pattern or array, where several individual luminarias are placed in, for example, a linear array along sidewalks, driveways, park trails, etc. Apart from its use for decorative and festive purposes, luminarias serve as navigation leads to guide people in poorly-lit areas. For example, luminarias are used in park trails to lead people to the location of, for example, a midnight concert.

There are several disadvantages with the luminarias used as discussed above, some of which are detailed here. First, when paper bags are used, they are prone to collecting moisture and breaking out or disintegrating, causing the ballast used inside to be strewn around and creating unwanted debris.

Second, when using ballast materials to weigh down the luminarias, a person is often unsure how much ballast material to fill inside the luminaria's container. This causes a person, in some instances, to overuse ballast causing the luminaria to become heavier and cumbersome to carry around, and also causes the outer container to tear away or wear out due to the additional weight. A person may also use too little ballast, failing to provide the luminaria with sufficient support to weigh it down.

Third, using water or other liquid ballasts to weigh down the luminaria causes a different set of problems. Use of water or liquids requires a closed container to be used within the luminaria to hold the ballast. When used in colder climates, the water freezes, causing its surface area to expand, leading to the container to crack or break.

Fourth, using candles within paper bags presents a substantial fire hazard. Even with ballast, the paper bags are prone to tipping over, causing the open flame from the candle to set the paper bag on fire. Even with a slight windy condition, the panels of the paper bag are prone to being blown toward the open flame, causing the paper bag to be set on fire.

Fifth, electric luminarias using string lights use the 120V alternating current, and present several hazards when used in out door environments. The electric luminaria has to be well insulated to prevent moisture from accumulating and creating the risk of electrocution. The use of the 120V AC power in outdoor environments also creates a fire hazard. The use of the insulators and other protective measures dramatically increases the cost of each luminaria, making it less attractive for use in extensive displays.

Sixth, some luminarias are rooted to the ground using nails or spikes instead of using ballast materials. However, as luminarias leave the traditional landscape and begin to be used on paved surfaces, nails or spikes are unusable to root the luminarias firmly.

SUMMARY OF THE INVENTION

An improved luminaria assembly with controlled ballast mechanism is provided. In one embodiment, the improved luminaria assembly has an outer container and an inner reservoir. In some instances, the outer container and inner reservoir are assembled over a common base. The inner reservoir is configured to hold a controlled volume of ballast for the improved luminaria assembly and also to hold an illuminating source. In one embodiment, spillover cavities are provided on the base region surrounding the inner reservoir to enable removal of excess ballast from the inner reservoir.

The spillover cavities ensure that any excess ballast is removed from the improved luminaria assembly. This, in conjunction with the volume controlled inner reservoir, ensure that an appropriate amount of ballast is utilized for holding down the improved luminaria assembly. Additionally, this ensures efficient usage of ballast and consequently brings down the overall cost of using the luminaria assembly.

The outer container, in some instances, has an open top portion. In some instances, the inner reservoir also has an open top portion. This ensures easy addition or removal of ballast material, allowing for reuse and further improvement in efficiency of usage of the luminaria assembly.

The improved luminaria assembly is used with any type of ballast material commonly used. In one embodiment, the improved luminaria assembly allows liquid ballast material to be used without requiring a closed container. This allows the ballast to expand or contract as affected by climate conditions without causing damage to the luminaria assembly.

The improved luminaria assembly is used with any type of illuminating source commonly used in such applications. In some instances, open flame sources (e.g., candles) are used, with water as the ballast material. The improved luminaria assembly reduces the probability of fire hazards because the water based ballast would extinguish the open fire when the luminaria is tipped over.

In one embodiment, a decorative sleeve is inserted in the region between the outer container and the inner reservoir. The decorative sleeve contains decorative elements that are visible when the luminaria is illuminated using the illuminating source. Because the spillover cavities drain away any excess ballast material in the region where the decorative sleeve is placed, there is limited or no obstruction to the placement of the decorative sleeve.

In some instances, the improved luminaria assembly is treated with fire retardants to mitigate fire hazards. In some cases, the improved luminaria assembly may be manufactured using a fire retardant compound (e.g., poly propylene).

BRIEF DESCRIPTION OF THE DRAWINGS

One or more embodiments of the present invention are illustrated by way of example and not limitation in the figures of the accompanying drawings, in which like references indicate similar elements and in which.

DETAILED DESCRIPTION

An improved luminaria with controlled ballast is described herein. Note that references in this specification to "an embodiment", "one embodiment", or the like, mean that the particular feature, structure or characteristic being described is included in at least one embodiment of the present invention. Occurrences of such phrases in this specification do not necessarily all refer to the same embodiment. The present invention may be embodied in several forms and manners.

The description provided below and the drawings show exemplary embodiments of the invention. Those of skill in the art will appreciate that the invention may be embodied in other forms and manners not shown below. It is understood that the use of relational terms, if any, such as first, second, top and bottom, and the like are used solely for distinguishing one entity or action from another, without necessarily requiring or implying any such actual relationship or order between such entities or actions.

Figure 1A:
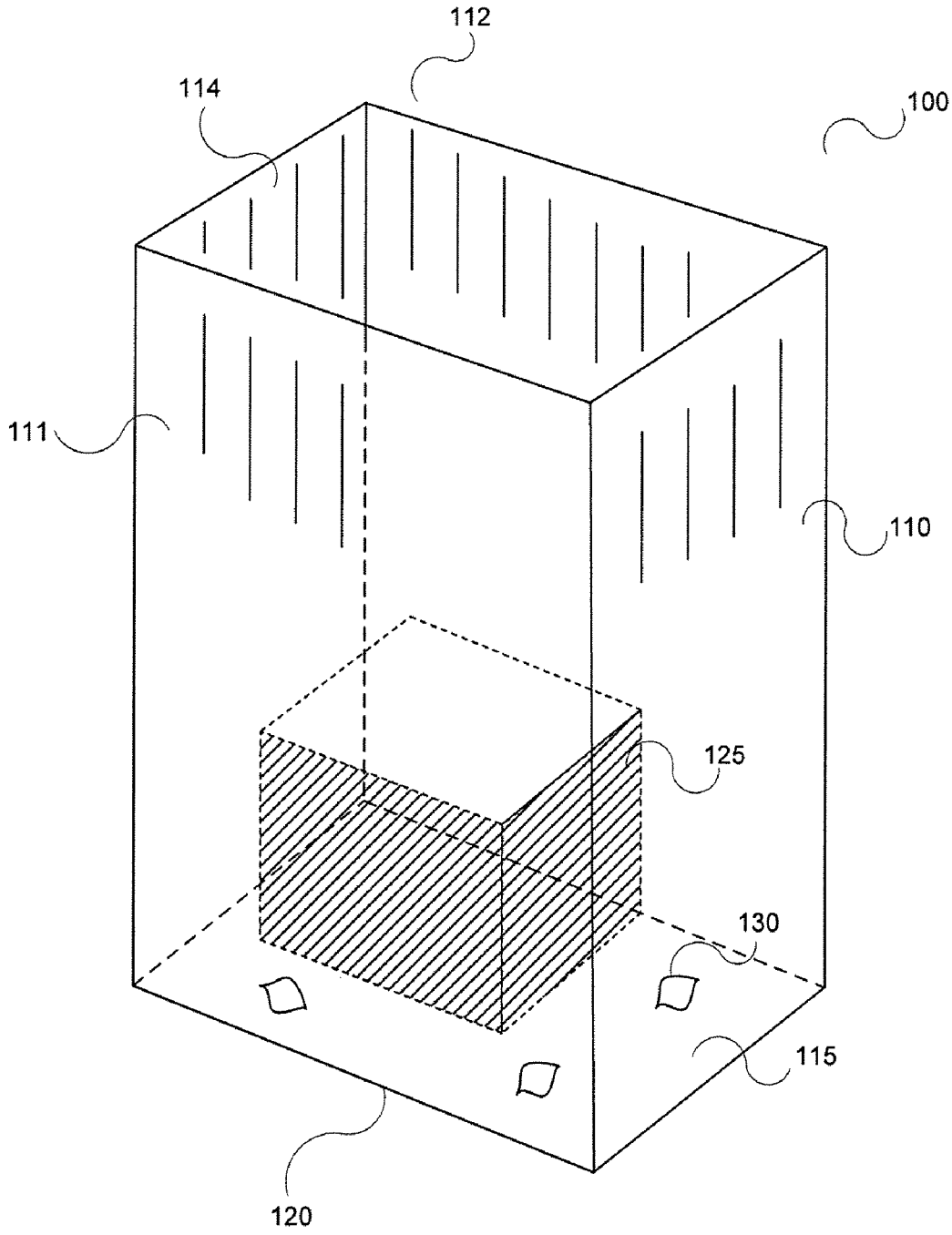
FIG. 1A illustrates one embodiment of an improved luminaria assembly 100.

FIG. 1A illustrates one embodiment of an improved luminaria assembly 100. In this embodiment, the luminaria assembly 100 has an outer container 120 and an inner container 125. The outer container 120, in some instances, has a base 115 that is rectangular in shape. In other instances, the base 115 could be circular or could be other shapes known to people skilled in the art and used in luminarias. The outer container 120 further has a plurality of outer panels (110, 111, 112, 114) over the base 115 to provide the shape and structure to the outer container 120. In some instances, the outer container 120 is made of paper, and in other instances, the outer container 120 is made of plastic or polypropylene or other materials known to people skilled in the art.

In one embodiment, the base 115 and the outer panels (110, 111, 112, 114) are formed as a single unit, for example, using a mould. In other embodiments, the base 115 and each of the outer panels (110, 111, 112, 114) are manufactured separately and assembled at a later stage. Other means of manufacture and assembly known to a person skilled in the art are equally employable. In some instances, the outer container 120 is in the shape of a cube. In other instances, the outer panels (110, 111, 112, 114) are at an angle to the base 115. It is appreciated that other shapes and structures of the outer panels (110, 111, 112, 114) known to people skilled in the art may be used for implementing the apparatus discussed herein.

In one embodiment, the improved luminaria assembly 100 includes an inner reservoir 125. In some instances, the inner reservoir 125 is congruent in shape and dimensions to the outer container 120 and is contained entirely within the outer container 120. In other instances, the inner reservoir 125 may be of different shapes and angles as compared to the outer container 120. The inner reservoir 125, in some instances, has a plurality of reservoir walls over the base 115. In one embodiment, the inner reservoir 125 shares the same base 115 as that of the outer container 120. In another embodiment, the inner reservoir 125 may have its own base layer attached to or elevated from the base 115 of the outer container.

In one embodiment, the outer container 120 and the inner reservoir 125 are manufactured as a single unit. In another embodiment, the outer container 120 and the inner reservoir 125 are manufactured as separate units and assembled at a later stage. In some instances, the improved luminaria 100 is assembled such that the inner reservoir can hold a certain predefined volume of ballast material. For example, in one instance, the improved luminaria 100 may be configured such that the inner reservoir 125 holds 20 ounces of ballast material. In some instances, the inner reservoir 125 is made of the same material as the outer container 120. In other instances, the inner reservoir 125 may be made of a different material.

In one embodiment, the outer container 120 has an uncovered top portion as shown in FIG. 1A. The uncovered top portion enables easy delivery of ballast material into the inner reservoir 125. Furthermore, in some embodiments, the inner reservoir 125 has an uncovered or open top portion. By allowing the top portion to be open, the inner reservoir 125 can hold, for example, a liquid ballast material without the problems of expansion of the ballast surface area when the liquid ballast freezes in colder temperatures. Any excess ballast or ballast exiting from the inner reservoir 125 spills over to the portion of the outer container 120 that is not covered by the inner reservoir 125.

In one embodiment, the region of the base 115 between the plurality of outer panels (110, 111, 112, 114) and the region of the base covered by the inner reservoir 125 is used to provide "spillover cavities" (e.g., 130). In some instances, the plurality of outer walls (110, 111, 112, 114) are separated from the reservoir walls by a predefined distance to allow for spillover cavities to be provided. The predefined distance is variable and may be fixed based on the overall size of the luminaria assembly 100 or by personal preference of the manufacturer. The spillover cavities are cavities in the base 115 of the improved luminaria assembly 100 designed to allow ballast material to drain or sift through. The number of spillover cavities may be determined based on the available space in the base 115 region, or by personal preference of the manufacturer.

When ballast material is filled into the inner reservoir 125, any excess ballast material spilling from the inner reservoir 125 spills over to the base 115 region surrounding the inner reservoir 125. Such ballast material sifts away through the spillover cavities (e.g., 130) and is thus automatically removed from the luminaria assembly 100. This allows controlled usage of ballast material, where the amount of ballast is controlled by the volume of the inner reservoir 125. Even if a user accidentally adds excess ballast material to the luminaria assembly 100, the excess material sifts away through the spillover cavities (e.g., 130). This ensures efficient usage of ballast in the luminaria bringing down the cost and inefficiency of using additional and unwarranted ballast material. In addition, in some embodiments, where the inner reservoir 125 and the outer container 120 have open top portions, the ballast material may be recollected after using the luminaria assembly 100 for reuse.

Furthermore, the outer container 120 and the inner reservoir 125 are configured such that they allow light to be displayed outside of the luminaria assembly 100 through the plurality of outer panels (110, 111, 112, 114).

Figure 1B:
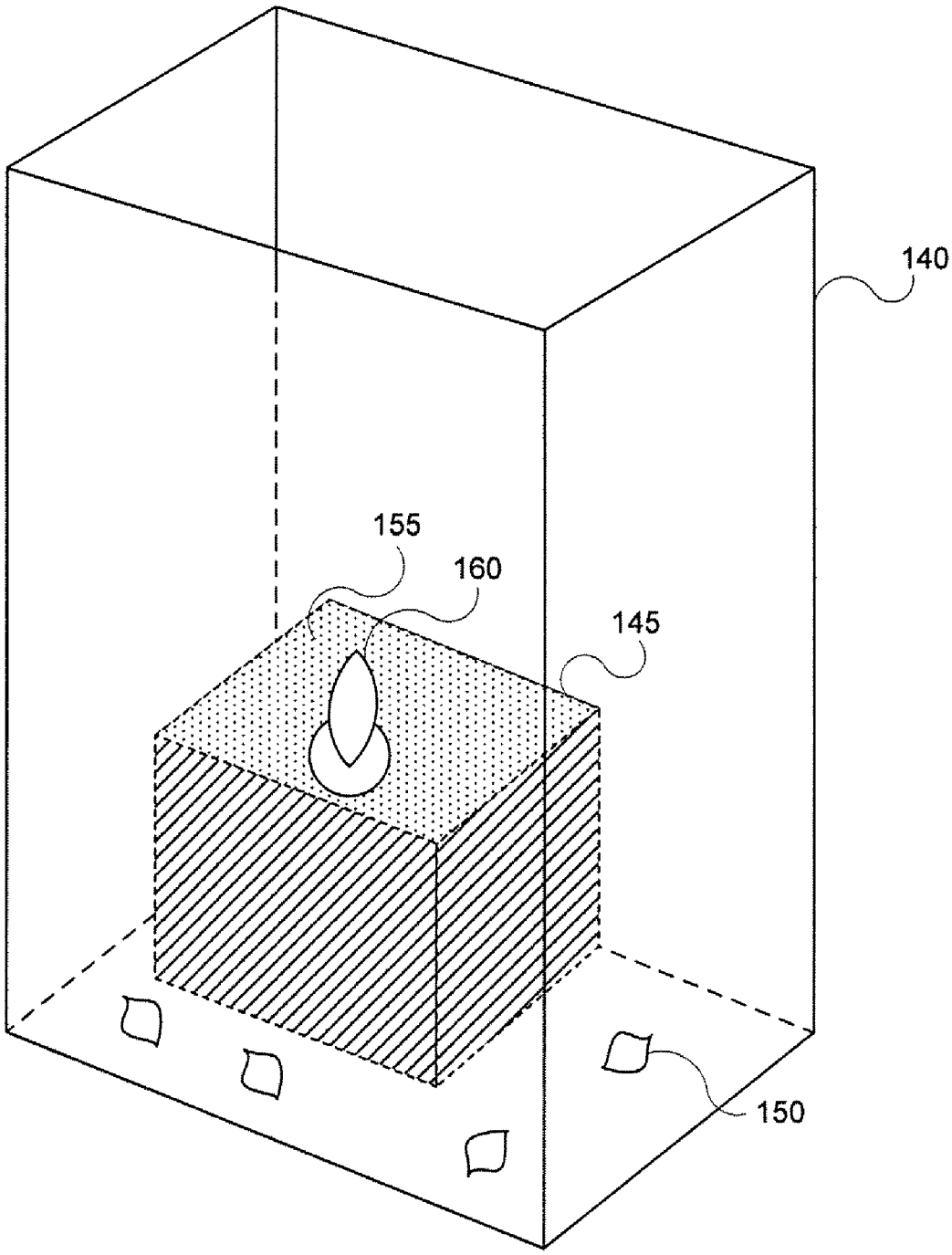
FIG. 1B illustrates one embodiment of the improved luminaria assembly with ballast material and an illuminating light source.

FIG. 1B illustrates one embodiment of the improved luminaria assembly with ballast material 155 and illuminating light source 160. As discussed before, in one embodiment, the improved luminaria assembly contains an outer container 140 and an inner reservoir 145. The region of the base between the outer container 140 and the inner reservoir 145 has at least one spillover cavity 150 to allow excess ballast material to escape outside of the luminaria assembly. The inner reservoir 145 is configured to hold a particular volume of ballast material 155 and allow the excess material to spill over to the region surrounding the inner reservoir 145.

In one embodiment, the ballast material 155 is filled to the top of the inner reservoir 145, and the illuminating source 160 is allowed to float or sit on top of the ballast material 155. In some instances, the illuminating source 160 is allowed to be submerged or suspended within the ballast material 155. For example, a LED light may be allowed to be submerged in a liquid based ballast material 155. Examples of ballast materials include water, liquid materials, gel based materials, sand, gravel, etc. Any type of illuminating source used for the purpose of luminarias may also be employed here. Some examples of illuminating sources include candles, votive candles, LED lights, electric lights, etc.

In one embodiment, water is used as ballast material 155 over which a candle with an open flame is allowed to float. Because the water is not sealed within the inner reservoir 145, it also acts as a flame retardant in the event of a fire. For example, if the improved luminaria assembly tips over, the water in the inner reservoir 145 is likely to extinguish the open the flame and make it harder for the luminaria assembly to be set on fire. In other embodiments, the improved luminaria assembly may also be manufactured using flame retardant materials to eliminate fire hazards, thus allowing open-flame candles to be used in the improved luminaria assembly. Additionally, when using a paper or cardboard based luminaria assembly, the improved luminaria assembly may also be treated with a fire retardant to mitigate any fire hazards.

Figure 2:
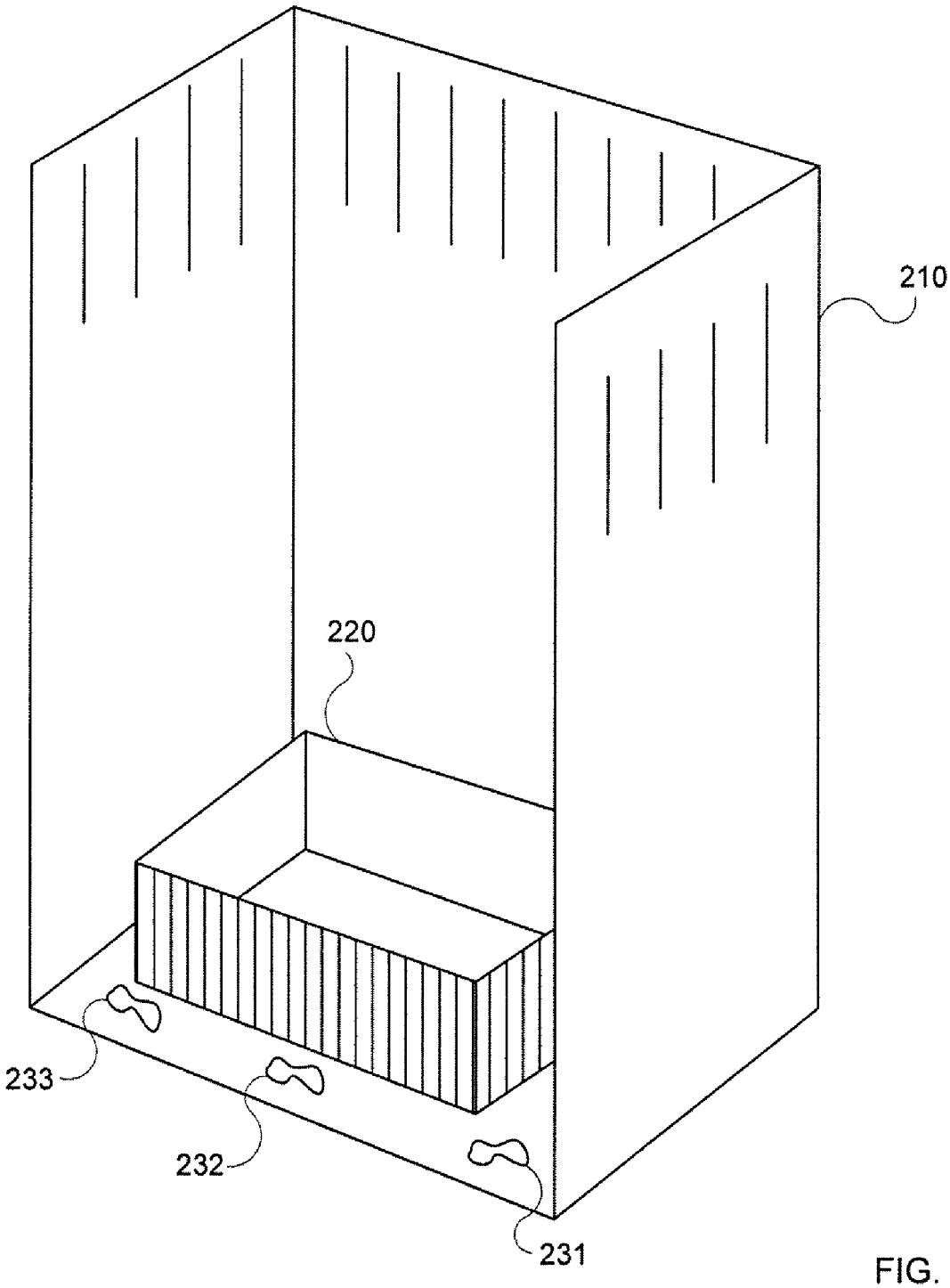
FIG. 2 is an embodiment depicting a cross section of the improved luminaria assembly.

FIG. 2 is an embodiment depicting a cross section of the improved luminaria assembly. As discussed above, the cross-section illustrates an outer container 210 and an inner reservoir 220. The inner reservoir, in some instances, is attached to the base of the outer container. In some instances, the inner reservoir may have its own base or may also be elevated from the base of the outer container using support attachments. The cross section of the improved luminaria assembly also depicts the spillover cavities (231, 232, 233). The spillover cavities (231, 232, 233), in one embodiment, are located on the base of the outer container 210, in the region surrounding the inner reservoir 220.

In some instances, the spillover cavities (231, 232, 233) are provided in patterns and in the shape of decorative arts to enhance the overall aesthetic value of the improved luminaria assembly. In other instances, a grid of openings may be provided to serve the utility of draining away excess ballast material. Other shapes, forms, and sizes of spillover cavities, as appreciated by people skilled in the art, are equally effective for placement of the spillover cavities (e.g., 231).

Figure 3:
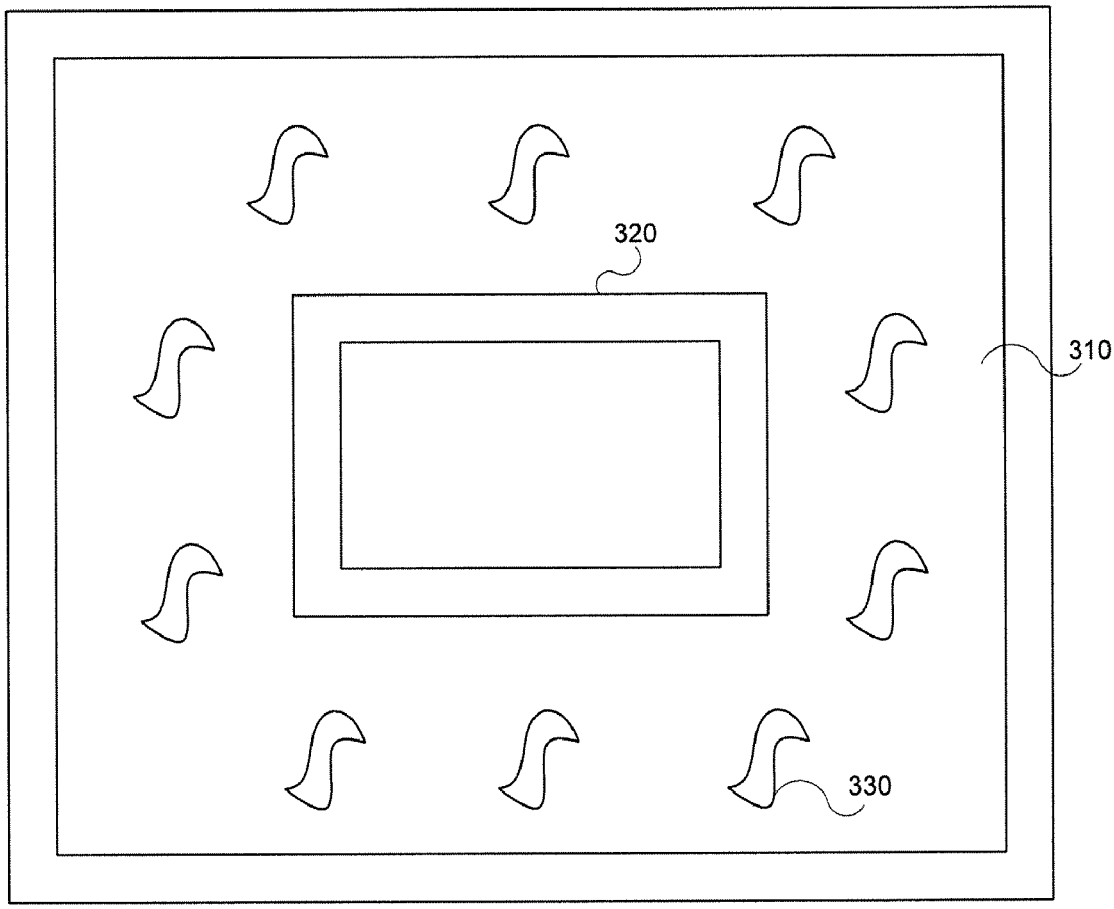
FIG. 3 depicts a view of the base portion of one embodiment of the improved luminaria assembly.

FIG. 3 depicts a view of the base portion of one embodiment of the improved luminaria assembly. In this embodiment, 310 is the base of the outer container. 320 represents the area of the base 310 that is covered, in some instances, by the inner reservoir. As illustrated here, the base region surrounding the inner reservoir is provided with at least one spillover cavity 330. In some embodiments, the spillover cavity 330 is provided in the form of a decorative shape. In one embodiment, a plurality of spillover cavities is placed in a pattern around the region covered by the inner reservoir.

Figure 4:
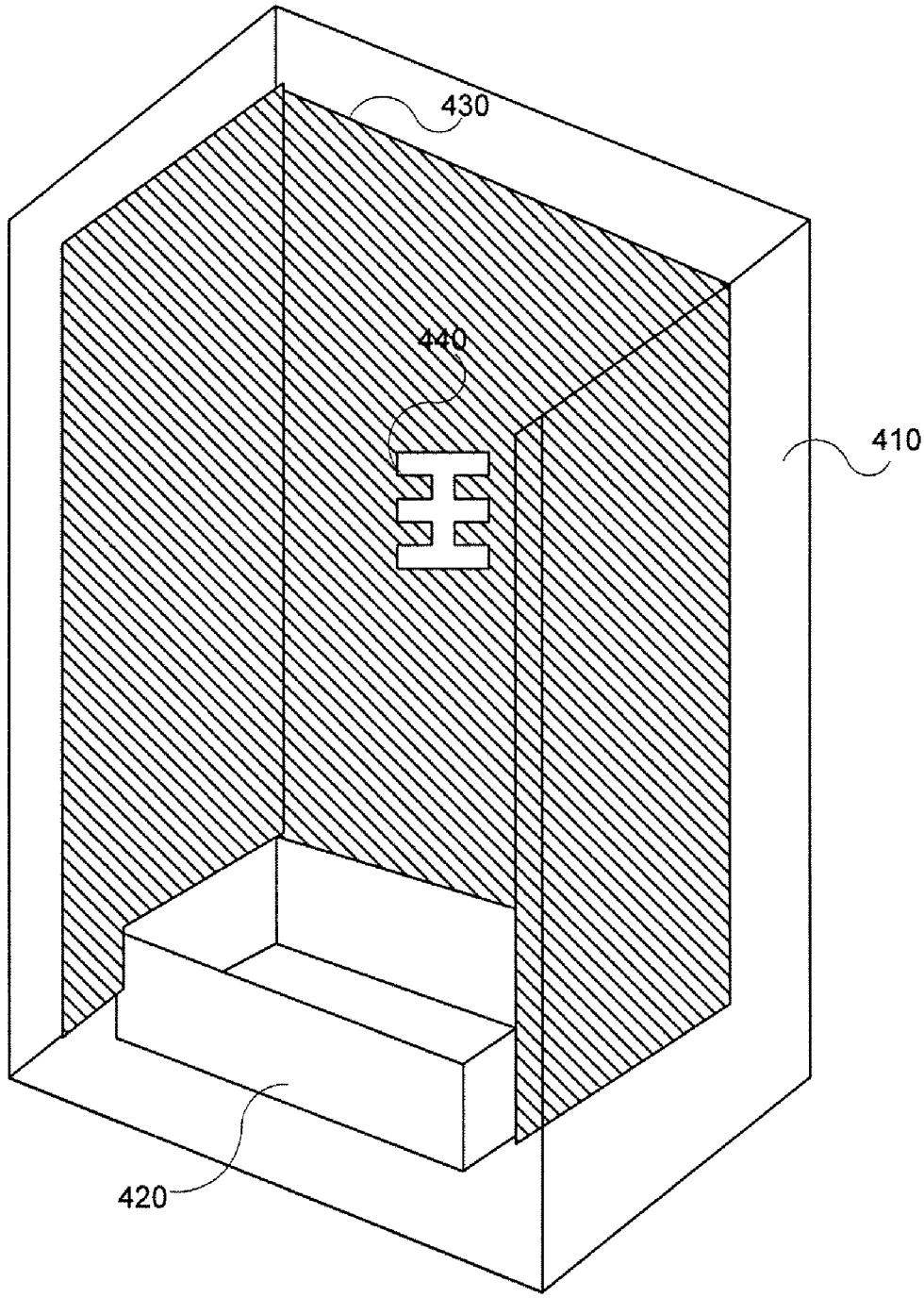
FIG. 4 illustrates one embodiment of the improved luminaria assembly that provides for a decorative sleeve to be inserted.

FIG. 4 illustrates one embodiment of the improved luminaria assembly that provides for a decorative sleeve to be inserted. The luminaria assembly, as discussed above, allows the light from the illuminating source to be emitted at least partially through the plurality of outer walls of the outer container 410. The luminaria also contains an inner reservoir 420 to hold the ballast material. The region between the inner reservoir and the outer container is configured such that a decorative sleeve 430 can be inserted. In one embodiment, the decorative sleeve allows light to permeate through, and also allows a decorative element or stencil-cut (e.g., 440) on the decorative sleeve to be displayed via the outer container 410 of the luminaria assembly.

In one embodiment, ridges or grooves may be provided on the base region or the plurality of outer walls to allow the decorative sleeve 430 to be inserted within the region between the inner reservoir 420 and the outer container 410. In some instances, the decorative sleeve 430 is placed without any ridge or groove support. In one embodiment, the decorative sleeve 430 is made of paper or cardboard with the requisite design element 440 stenciled out or otherwise placed over the decorative sleeve 430.

In some instances, the decorative sleeve 430 is treated with a flame retardant to mitigate the risks of fire accidents when an open-flame illuminating source is utilized. Additionally, the provision of the spillover cavities (as discussed before) ensures that ballast materials do not stagnate in the region where the decorative sleeve 430 is placed, ensuring that ballast materials do not obstruct the placement or insertion of the decorative sleeve 430.

Figure 5:
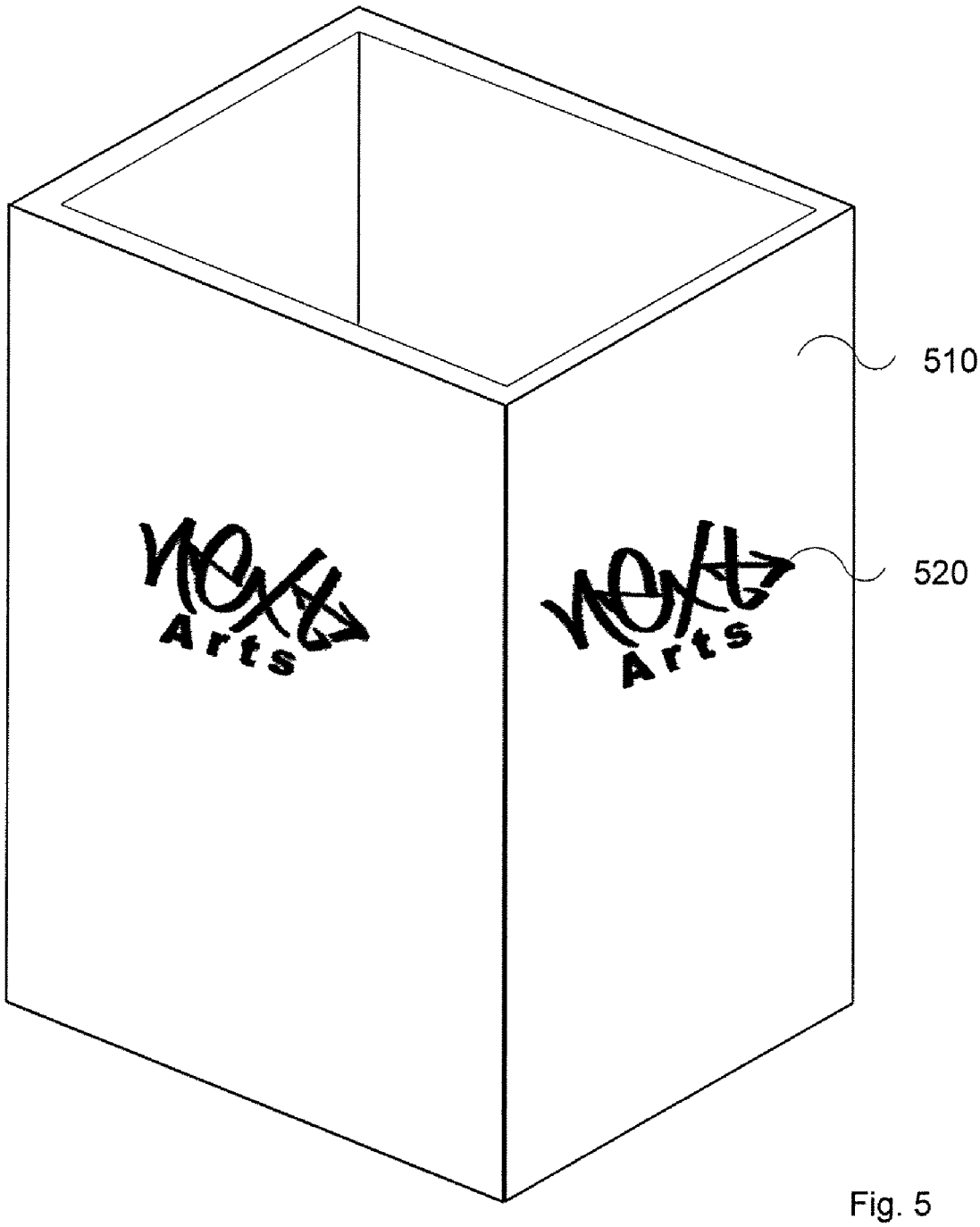
FIG. 5 illustrates one embodiment of the improved luminaria assembly displaying a design from a decorative sleeve.

FIG. 5 illustrates one embodiment of the improved luminaria assembly displaying a design from a decorative sleeve. The improved luminaria assembly has an outer container 510. An illuminating source inside the luminaria assembly illuminates the outer container 510. A decorative sleeve (not shown in FIG. 5) placed inside the inner container, according to the techniques described above, allows a design element 520 of the decorative sleeve to be displayed through the outer container.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

What is claimed is:

1. An improved luminaria assembly comprising:

an outer container including a base and a plurality of side panels assembled over the base; and an inner reservoir configured to hold a ballast for the luminary assembly, wherein the inner reservoir is formed inside the outer container and includes a plurality of reservoir side panels formed over the base such that the plurality of reservoir panels are separated from the plurality of outer panels by a gap, further wherein:

the inner reservoir is configured to hold an illuminating source, wherein light from the illuminating source is emitted at least partially through the plurality of side panels of the outer container;

the inner reservoir is further configured to hold a controlled volume of ballast to ensure that an appropriate amount of the ballast is utilized to hold the improved luminaria assembly in an upright position; and the region of the base between the plurality of outer panels and the plurality of reservoir panels includes a plurality of spillover cavities, wherein the plurality of spillover cavities is placed in a pattern around the region covered by the inner reservoir and is configured to effectively drain out excess ballast spilling over from the inner reservoir to the base to ensure that the controlled volume of the ballast is maintained at all times by filling into the inner reservoir a volume of the ballast equal to or greater than the volume of the inner reservoir, wherein the spillover cavities are for draining the excess ballast spilling over from the inner reservoir away from the improved luminaria assembly to maintain the appropriate amount of the ballast to hold the improved luminaria assembly in the upright position.

2. The improved luminaria assembly as recited in claim 1, further comprising:

a decorative sleeve inserted between the plurality of outer panels and the plurality of reservoir panels.

3. The improved luminaria assembly as recited in claim 2, wherein the plurality of spillover cavities ensure that any ballast spilling over from the inner reservoir does not obstruct the insertion or placement of the decorative sleeve.

4. The improved luminaria assembly as recited in claim 3, wherein both the outer container and the inner reservoir have an open top potion to enable delivery of the ballast to the inner reservoir.

5. The improved luminaria assembly as recited in claim 3, wherein the plurality of outer panels are tapered at an angle over the base, enabling two or more luminary assemblies to be stacked for efficient storage.

6. The improved luminaria assembly as recited in claim 3, wherein the illuminating source is placed over the ballast within the inner reservoir.

7. The improved luminaria assembly as recited in claim 3, wherein the illuminating source is submerged within the ballast in the inner reservoir.

8. The improved luminaria assembly as recited in claim 3, wherein the decorative sleeve is removable, and wherein the decorative sleeve is replaceable with a different decorative sleeve.

9. The improved luminaria assembly as recited in claim 1, wherein both the outer container and the inner reservoir have an open top potion to enable delivery of the ballast to the inner reservoir.

10. The improved luminaria assembly as recited in claim 9, wherein the open top portion enables the ballast material to be collected from the luminary assembly and reused.

11. The improved luminaria assembly as recited in claim 1, wherein the illuminating source includes at least one of:

votives;

candles;

LED lights; or electric lights.

12. The improved luminaria assembly as recited in claim 1, wherein the ballast includes at least one of:

water;

gravel;

sand; or marbles.

13. The improved luminaria assembly as recited in claim 1, wherein the plurality of outer panels are tapered at an angle over the base, enabling two or more luminary assemblies to be stacked for efficient storage.

14. The improved luminaria assembly as recited in claim 1, wherein the illuminating source is placed either over the ballast within the inner reservoir or submerged within the ballast in the inner reservoir.

15. The improved luminaria assembly as recited in claim 1, wherein the spillover cavities have the shape of decorative arts to enhance the overall aesthetic value of the improved luminaria assembly.

16. A method of manufacturing an improved luminaria assembly, the method comprising:

forming an outer container, the outer container including a base and a plurality of side panels assembled over the base;

forming an inner reservoir inside the outer container, the inner reservoir configured to hold a ballast for the luminary assembly, wherein the inner reservoir includes a plurality of reservoir side panels formed over the base such that the plurality of reservoir panels are separated from the plurality of outer panels by a gap, further wherein:

the inner reservoir is configured to hold an illuminating source wherein light from the illuminating source is emitted at least partially through the plurality of side panels of the outer container; and the inner reservoir is further configured to hold a controlled volume of ballast to ensure that an appropriate amount of the ballast is utilized to hold the improved luminaria assembly in an upright position; and forming a plurality of spillover cavities in the region of the base between the plurality of outer panels and the plurality of reservoir panels, wherein the plurality if spillover cavities is placed in a pattern around the region covered by the inner reservoir and is configured to effectively drain out excess ballast spilling over from the inner reservoir to the base to ensure that the controlled volume of ballast is maintained at all times by filling into the inner reservoir a volume of the ballast equal to or greater than the volume of the inner reservoir, wherein the spillover cavities are for draining the excess ballast spilling over from the inner reservoir away from the improved luminaria assembly to maintain the appropriate amount of the ballast to hold the improved luminaria assembly in the upright position.

17. The method as recited in claim 16, wherein the spillover cavities have the shape of decorative arts to enhance the overall aesthetic value of the improved luminaria assembly.

18. A method comprising:

filling a luminaria assembly with a volume of ballast, wherein the luminaria assembly includes:

an outer container including a base and a plurality of side panels assembled over the base; and an inner reservoir configured to hold the ballast for the luminaria assembly, wherein the inner reservoir is formed inside the outer container and includes a plurality of reservoir side panels formed over the base such that the plurality of reservoir panels are separated from the plurality of outer panels by a gap, further wherein:

the inner reservoir is configured to hold an illuminating source wherein light from the illuminating source is emitted at least partially through the plurality of side panels of the outer container;

the inner reservoir is further configured to hold a controlled volume of ballast to ensure that an appropriate amount of the ballast is utilized to hold the improved luminaria assembly in an upright position;

the region of the base between the plurality of outer panels and the plurality of reservoir panels includes a plurality of spillover cavities, wherein the plurality of spillover cavities is placed in a pattern around the region covered by the inner reservoir and is configured to effectively drain out excess ballast spilling over from the inner reservoir to the base to ensure that the controlled volume of ballast is maintained at all times by filling into the inner reservoir a volume of the ballast equal to or greater than the volume of the inner reservoir, wherein the spillover cavities are for draining the excess ballast spilling over from the inner reservoir away from the improved luminaria assembly to maintain the appropriate amount of the ballast to hold the improved luminaria assembly in the upright position; and the volume of ballast filled into the luminaria assembly is equal to or greater than the volume of the inner reservoir and fills the inner reservoir; and draining the excess ballast spilling over from the inner reservoir away from the improved luminaria assembly to maintain the appropriate amount of the ballast to hold the improved luminaria assembly in the upright position.

* * * * *